US011143148B2

(12) United States Patent
Chen

(10) Patent No.: US 11,143,148 B2
(45) Date of Patent: Oct. 12, 2021

(54) AIR REACTIVATOR

(71) Applicant: Tung-Sen Chen, New Taipei (TW)

(72) Inventor: Tung-Sen Chen, New Taipei (TW)

( * ) Notice: Subject to any disclaimer, the term of this patent is extended or adjusted under 35 U.S.C. 154(b) by 160 days.

(21) Appl. No.: 16/705,381

(22) Filed: Dec. 6, 2019

(65) Prior Publication Data

US 2021/0172406 A1 Jun. 10, 2021

(51) Int. Cl.
*F02M 33/00* (2006.01)
*B01F 3/02* (2006.01)
*B01F 5/00* (2006.01)

(52) U.S. Cl.
CPC ..... *F02M 33/00* (2013.01); *B01F 3/026* (2013.01); *B01F 5/0057* (2013.01)

(58) Field of Classification Search
CPC ..... F02M 33/00; B01F 5/0057; B01F 3/026
See application file for complete search history.

(56) References Cited

U.S. PATENT DOCUMENTS 4,672,940 A * 6/1987 Nakayama ..... F02M 29/04 123/590

6,923,841 B2 * 8/2005 Chen ..... B01D 46/10 123/198 E

FOREIGN PATENT DOCUMENTS

| | | |
|---|---|---|
| TW | M305263 U | 1/2007 |
| TW | M358880 U | 6/2009 |
| TW | M531984 U | 11/2016 |
| TW | M551227 U | 11/2017 |

* cited by examiner

*Primary Examiner* — Kevin A Lathers
(74) *Attorney, Agent, or Firm* — Alan D. Kamrath; Karin L. Williams; Mayer & Williams PC

(57) ABSTRACT

An air reactivator includes a plurality of first ribs, a plurality of second ribs, a plurality of diffusion members, and a plurality of air passages. Each of the first ribs has a first top face and a first bottom face and two first inclined faces. Each of the second ribs has a second top face and a second bottom face and two second inclined faces. The diffusion members are defined at connections of the first ribs and the second ribs. Each of the diffusion members has a projection and a third bottom face and a recessed portion. Each of the air passages is defined between the first inclined face, the second inclined face, and the recessed portion. The first ribs, the second ribs, and the diffusion members are made of a mixture of far infrared emitting material and polymer material.

7 Claims, 4 Drawing Sheets

| | before mounting the air reactivator | | | after mounting the air reactivator | | |
|---|---|---|---|---|---|---|
| | fuel consumption (km／L) | H C (ppm) | C O (%) | fuel consumption (km／L) | H C (ppm) | C O (%) |
| Test Car 1 | 10 | 364 | 0.3 | 12 | 101 | 0.15 |
| Test Car 2 | 8.2 | 257 | 0.2 | 9.8 | 121 | 0.10 |
| Test Car 3 | 15.9 | 121 | 0.3 | 17.1 | 96 | 0 |
| Test Car 4 | 15.1 | 129 | 0.25 | 16.9 | 101 | 0.1 |
| Test Car 5 | 14.1 | 131 | 0.2 | 16.2 | 96 | 0 |
| Test Car 6 | 12.4 | 124 | 0.1 | 14.2 | 97 | 0 |

Fig. 4

AIR REACTIVATOR

BACKGROUND OF THE INVENTION

1. Field of the Invention

The present invention relates to a reactivator and, more particularly, to an air reactivator.

2. Description of the Related Art

With the development of environmental protection laws and regulations, restriction on the air exhaust of the internal combustion engine used by various vehicles has become increasingly stricter. During the operation of the internal combustion engine, it will mix air and fuel to generate kinetic energy. Without changing the structure of the internal combustion engine, many companies have developed devices that use far-infrared rays and magnetic forces to process the air entering the internal combustion engine to increase the combustion efficiency after the mixture of oil and gas.

Taiwanese Patent Publication No. M551227 disclosed an "Automotive Intake Optimized Gasket", and Taiwanese Patent Publication No. M305263 disclosed an "Automotive Environmental Protection Horsepower Booster". The above two patents are limited to air holes of different dimensions, such that when the air contacts the blocks, a large amount of turbulent flow is generated at the interface of the air holes, thereby reducing the intake efficiency.

Taiwanese Patent Publication No. M531984 disclosed an "Air Refinement Device". Although this patent can increase the contact times of the air with the wave plate, the air is divided to flow along the two sides of the wave plate after contacting the wave plate, such that a turbulent flow is produced at the bottom of the wave plate, thereby reducing the intake efficiency.

Taiwanese Patent Publication No. M358880 disclosed an "Automotive fuel-saving device". The diameter of the through hole is too large, and the passing speed is too fast, such that the far infrared material and the air cannot perform a reactivation. In addition, the air filter of the car allows passage of the air instead of the fuel.

In the current vacuum braking system, the combustion efficiency of the engine room cannot reach the original design, such that the air density and the vacuum degree of the engine room are lost, which affects the vacuum degree of the intake manifold. In general, the force of the vacuum applied on the braking pump is designed in such a manner that the braking rate of the front wheel braking system and the rear wheel braking system is about 7:3 or 6:4. However, the vacuum degree of the intake manifold is not enough or the air pressure is not enough, such that the car head has a better braking effect, and the car tail has a poor braking effect. Thus, when an emergency braking happens, the car head easily sinks forward, the car tail is easily lifted, and easily flicks or swings, and the car easily slips sideward, thereby causing danger to the driver.

BRIEF SUMMARY OF THE INVENTION

In accordance with the present invention, there is provided an air reactivator comprising a plurality of first ribs, a plurality of second ribs, a plurality of diffusion members, and a plurality of air passages. The air reactivator is mounted on an outside of an internal combustion engine, and is connected to an air flow channel of a fuel intake system.

Each of the first ribs has a first top face and a first bottom face. Each of the first ribs has two sides each having a first inclined face. Each of the second ribs has a second top face and a second bottom face. Each of the second ribs has two sides each having a second inclined face. The second ribs are connected with the first ribs respectively. The diffusion members are defined at connections of the first ribs and the second ribs. Each of the diffusion members has a projection and a third bottom face. Each of the diffusion members has a recessed portion formed on an intersection of the first inclined face and the second inclined face. Each of the air passages is defined between the first inclined face, the second inclined face, and the recessed portion. The first ribs, the second ribs, and the diffusion members are made of a mixture of far infrared emitting material and polymer material. When a water molecular cluster of an air with a relative humidity contacts the first ribs, the second ribs, and the diffusion members, the first top face, the second top face, and the projection guides and accelerates the air to pass the air passages rapidly, while the first inclined face, the second inclined face, and the recessed portion produce a diffuse effect and increase a contact area of the far infrared emitting material and the air. After the air contacts the far infrared emitting material, the air is perturbed to form a vortex flow and to increase a contact time of the far infrared emitting material and the air, such that the water molecular cluster of the air produce resonance and is atomized or made smaller by the far infrared emitting material, and a molecular freedom of the air is enhanced. The water molecular cluster of the air has an enhanced oxygen contained area, and has an increased contact area with a fuel, such that the water molecular cluster of the air is mixed with the fuel evenly.

Preferably, the far infrared emitting material includes, but is not limited to, a composition of magnesium oxide (MgO), silicon dioxide ($SiO_2$), titanium dioxide ($TiO_2$), aluminum oxide ($Al_2O_3$), iron oxide ($Fe_2O_3$), calcium oxide (CaO), chromium oxide ($Cr_2O_3$), manganese oxide (MnO), nickel oxide ($NiO_2$), cobalt oxide (CoO), zirconium oxide or zirconia ($ZrO_2$), sodium oxide (NaO), and potassium oxide ($K_2O$), which are mixed, sintered and ground at a weight (or mass) proportion of 2: 3: 2: 1: 1: 1: 2: 2: 3: 3: 1: 1: 2.

Preferably, the far infrared emitting material has a granularity of 0.01-30 micrometers.

Preferably, the polymer material includes polyethylene (PE), polypropylene (PP), polyurethane (PU) or Nylon.

Preferably, the far infrared emitting material has an far-infrared emissivity, more than 80%.

Preferably, the first ribs, the second ribs, and the diffusion members are formed integrally by plastic injection molding.

Preferably, the first ribs intersect the second ribs respectively, and the diffusion members are formed on intersections of the first ribs and the second ribs, and connects the first ribs and the second ribs.

Preferably, the first top face has an area smaller than that of the first bottom face, the second top face has an area smaller than that of the second bottom face, and the projection has an area smaller than that of the third bottom face.

Preferably, the projection has a height greater than that of the first top face and that of the second top face.

According to the primary advantage of the present invention, the air reactivator has a simplified structure, has a low cost, and has a high air circulation.

According to another advantage of the present invention, the water molecular cluster of the air produce resonance and is atomized or made smaller, and the molecular freedom of the air is enhanced.

According to a further advantage of the present invention, after the water molecular cluster of the air produce resonance and is atomized, the water molecular cluster of the air has an enhanced oxygen contained area, and has an increased contact area with a fuel, such that the air forms a vortex flow and increases a reactivating time, and the water molecular cluster of the air is mixed with the fuel evenly.

According to a further advantage of the present invention, the water molecular cluster of the air has an enhanced oxygen contained area, to increase the air pressure, such that the air density of the braking pump is increased, to shorten the braking distance, and to enhance the braking safety.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

FIG. 4 is a test report showing usage of the air reactivator in accordance with the preferred embodiment of the present invention.

DETAILED DESCRIPTION OF THE INVENTION

Figure 1:
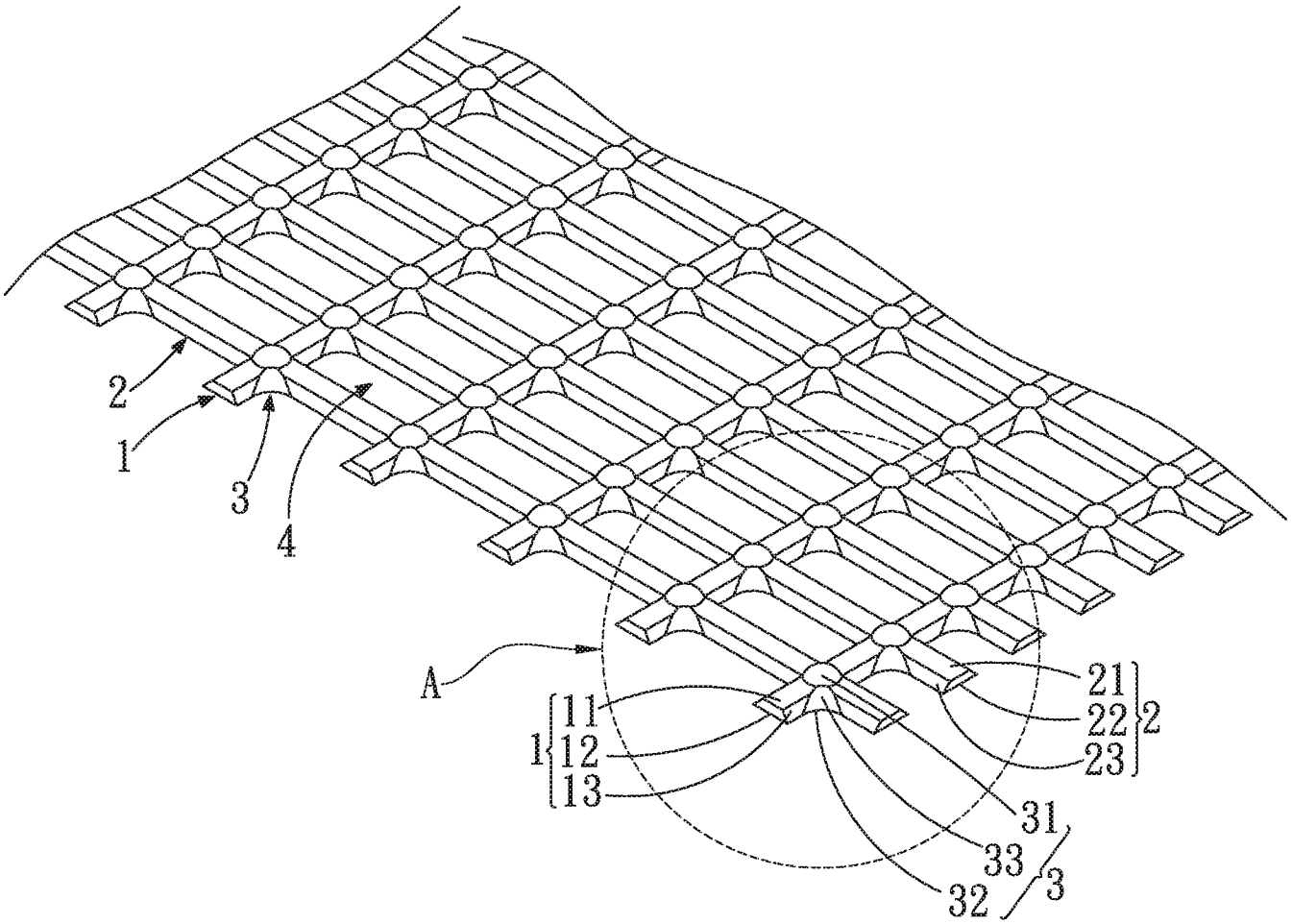
FIG. 1 is a perspective view of an air reactivator in accordance with the preferred embodiment of the present invention.
Figure 2:
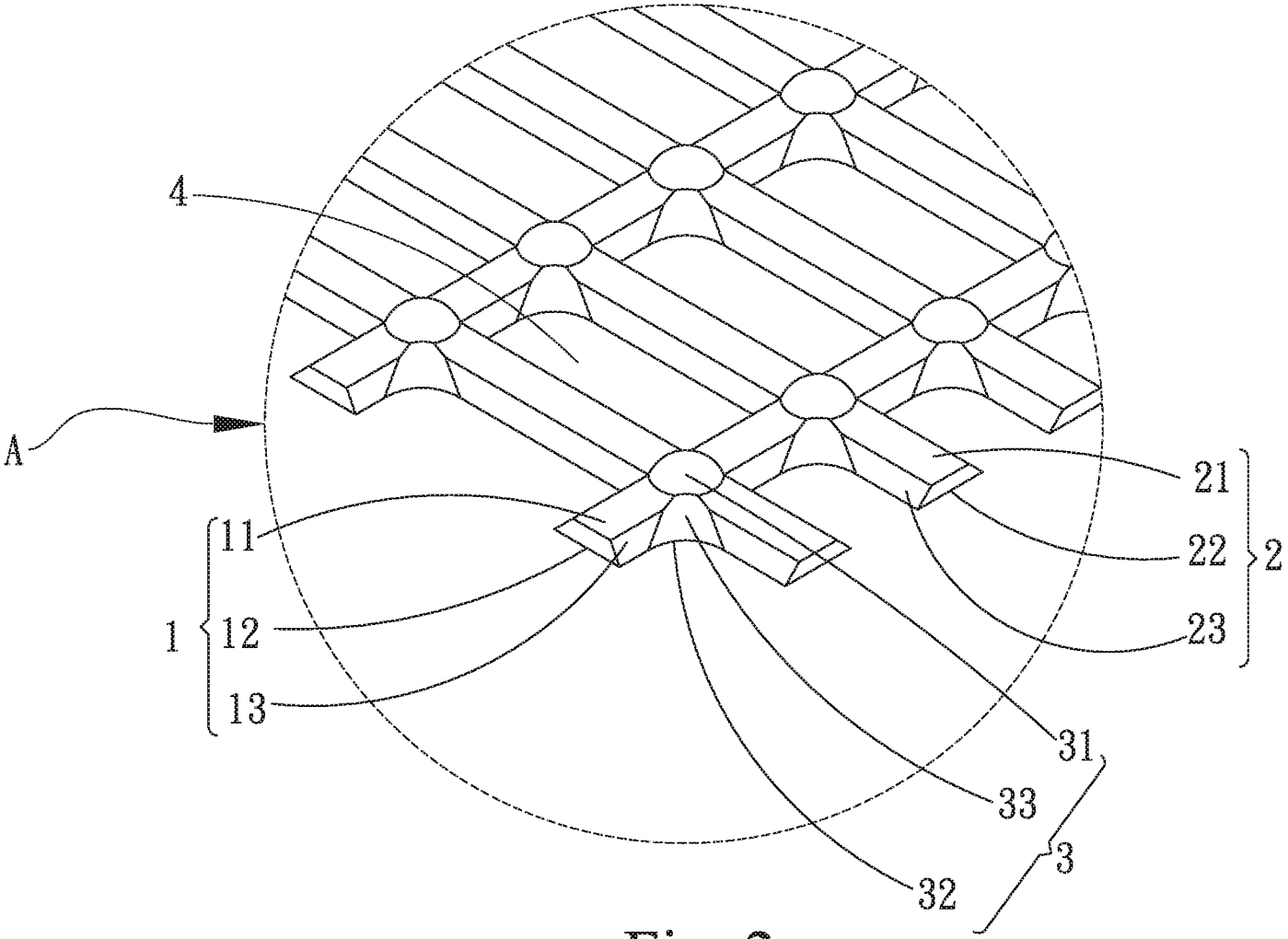
FIG. 2 is a locally enlarged view of the air reactivator taken along circle A as shown in FIG. 1.

Referring to the drawings and initially to FIGS. 1 and 2, an air reactivator in accordance with the preferred embodiment of the present invention comprises a plurality of first ribs 1, a plurality of second ribs 2, a plurality of diffusion members (or spoilers or vortex generators or turbulence generators) 3, and a plurality of air passages (or channels) 4. The air reactivator is mounted on an outside of an internal combustion engine, and is connected to an air flow channel of a fuel intake system. The first ribs 1 are spaced from each other. The second ribs 2 are spaced from each other. The diffusion members 3 are arranged in a matrix. The air passages 4 are arranged in a matrix.

Each of the first ribs 1 has a first top face 11 and a first bottom face 12. Each of the first ribs 1 has two sides each having a first inclined face 13. Each of the second ribs 2 has a second top face 21 and a second bottom face 22. Each of the second ribs 2 has two sides each having a second inclined face 23. The second ribs 2 are connected with the first ribs 1 respectively. The diffusion members 3 are defined at connections of the first ribs 1 and the second ribs 2. Each of the diffusion members 3 has a projection 31 and a third bottom face 32. Each of the diffusion members 3 has a recessed portion 33 formed on an intersection of the first inclined face 13 and the second inclined face 23. Each of the air passages 4 is defined between the first inclined face 13, the second inclined face 23, and the recessed portion 33. Preferably, the first ribs 1, the second ribs 2, and the diffusion members 3 are made of a mixture of far infrared emitting material (or a means for emitting far infrared radiation) and polymer material.

In practice, when a water molecular cluster of an air with a relative humidity contacts the first ribs 1, the second ribs 2, and the diffusion members 3, the first top face 11, the second top face 21, and the projection 31 guides and accelerates the air to pass the air passages 4 rapidly, while the first inclined face 13, the second inclined face 23, and the recessed portion 33 produce a diffuse effect and increase a contact area of the far infrared emitting material and the air. After the air contacts the far infrared emitting material, the air is perturbed (or disturbed) to form a vortex flow and to increase a contact time of the far infrared emitting material and the air, such that the water molecular cluster of the air produce resonance and is atomized or made smaller by the far infrared emitting material, and a molecular freedom of the air is enhanced. In such a manner, the water molecular cluster of the air has an enhanced oxygen contained area, and has an increased contact area with a fuel, and a brake pressure of a vacuum braking system is increased, such that the water molecular cluster of the air is mixed with the fuel evenly. Thus, the air reactivator helps a complete interior burning of the internal combustion engine, to decrease drain of the waste gas, to enhance the power of the internal combustion engine, to prevent the carbon from being accumulated in the engine room (or chamber), to enhance the lifetime of the internal combustion engine, and to shorten the braking distance.

In the preferred embodiment of the present invention, the far infrared emitting material includes, but is not limited to, a composition of magnesium oxide (MgO), silicon dioxide ($SiO_2$), titanium dioxide ($TiO_2$), aluminum oxide ($Al_2O_3$), iron oxide ($Fe_2O_3$), calcium oxide (CaO), chromium oxide ($Cr_2O_3$), manganese oxide (MnO), nickel oxide ($NiO_2$), cobalt oxide (CoO), zirconium oxide or zirconia ($ZrO_2$), sodium oxide (NaO), and potassium oxide ($K_2O$), which are mixed, sintered and ground at a weight (or mass) proportion of 2: 3: 2: 1: 1: 1: 2: 2: 3: 3: 1: 1: 2.

In the preferred embodiment of the present invention, the far infrared emitting material has a granularity of, but not limited to, 0.01-30 micrometers.

In the preferred embodiment of the present invention, the polymer material includes, but is not limited to, polyethylene (PE), polypropylene (PP), polyurethane (PU) or Nylon.

In the preferred embodiment of the present invention, the far infrared emitting material has an far-infrared emissivity, more than, but not limited to, 80%.

In the preferred embodiment of the present invention, the first ribs 1, the second ribs 2, and the diffusion members 3 are formed integrally by plastic injection molding.

In the preferred embodiment of the present invention, the first ribs 1 intersect the second ribs 2 respectively, and the diffusion members 3 are formed on intersections of the first ribs 1 and the second ribs 2, and connects the first ribs 1 and the second ribs 2.

In the preferred embodiment of the present invention, the first top face 11 has an area smaller than that of the first bottom face 12, the second top face 21 has an area smaller than that of the second bottom face 22, and the projection 31 has an area smaller than that of the third bottom face 32.

In the preferred embodiment of the present invention, the projection 31 has a height greater than that of the first top face 11 and that of the second top face 21.

Figure 3:
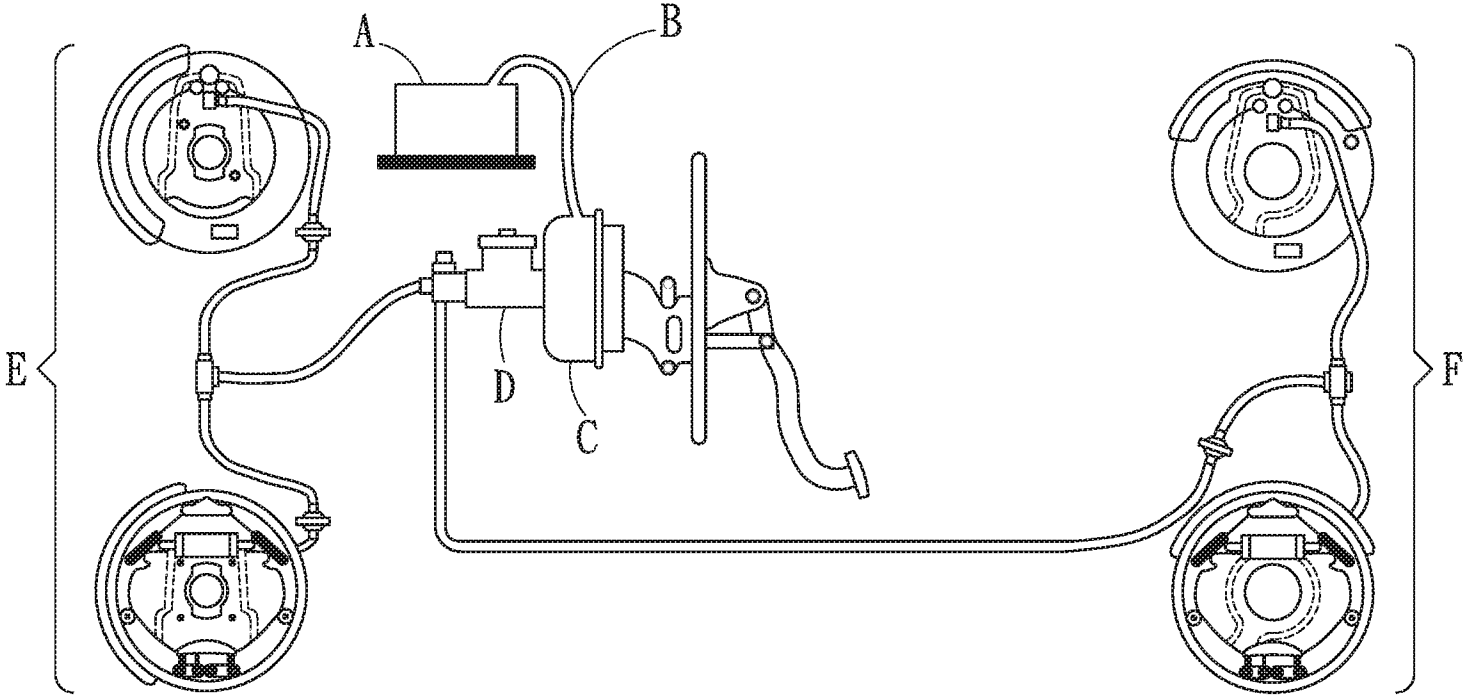
FIG. 3 is a schematic operational view showing the air reactivator which is used for a braking system.

Referring to FIG. 3 with reference to FIGS. 1 and 2, the air reactivator is mounted on an outside of an engine room A. The air reactivator introduces the atomized water molecular cluster of the air into the engine room A, to increase the combustion efficiency of the engine room A, and to prevent the carbon from being accumulated in the engine room A, thereby increasing the air density and the vacuum degree of the engine room A. Then, the atomized water molecular cluster enters an intake manifold B, to enhance the vacuum degree of a vacuum pump C, and to increase a brake pressure of a braking pump D. The vacuum pump C applies a force on the braking pump D evenly and steadily during the braking process, such that the braking pump D delivers the braking oil to a brake matching unit steadily, such that the braking oil enters and is evenly distributed in a front wheel braking system E and a rear wheel braking system F. Thus, the pressure is applied to the front wheel braking system E and the rear wheel braking system F evenly and steadily according to a determined proportion, such as 7:3 or 6:4, so as to achieve a balanced braking, thereby preventing the car head from sinking forward, preventing the car tail from being lifted, preventing the car tail from flicking or swinging, and preventing the car from slipping sideward during an emergency braking. In addition, the braking distance is shortened.

Referring to FIG. 4, six cars are tested to measure and compare the fuel consumption, the CO (carbon oxide) emission, and the HC (hydrocarbon) emission of the cars before and after mounting the air reactivator. According to the test report, the driving distance (kilometer) per litter is increased, which means the fuel consumption is decreased. In addition, the CO emission is decreased, and the HC emission is also decreased. It is noted that, when the CO emission is zero, it means that the CO emission is smaller than 0.01.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. An air reactivator comprising:

a plurality of first ribs, a plurality of second ribs, a plurality of diffusion members, and a plurality of air passages;

wherein:

the air reactivator is mounted on an outside of an internal combustion engine, and is connected to an air flow channel of a fuel intake system;

each of the first ribs has a first top face and a first bottom face;

each of the first ribs has two sides each having a first inclined face;

each of the second ribs has a second top face and a second bottom face;

each of the second ribs has two sides each having a second inclined face;

the second ribs are connected with the first ribs respectively;

the diffusion members are defined at connections of the first ribs and the second ribs;

each of the diffusion members has a projection and a third bottom face;

each of the diffusion members has a recessed portion formed on an intersection of the first inclined face and the second inclined face;

each of the air passages is defined between the first inclined face, the second inclined face, and the recessed portion;

the first ribs, the second ribs, and the diffusion members are made of a mixture of a means for emitting far infrared radiation and polymer material;

when a water molecular cluster of an air with a relative humidity contacts the first ribs, the second ribs, and the diffusion members, the first top face, the second top face, and the projection guides and accelerates the air to pass the air passages rapidly, while the first inclined face, the second inclined face, and the recessed portion produce a diffuse effect and increase a contact area of the means for emitting far infrared radiation and the air;

after the air contacts the means for emitting far infrared radiation, the air is perturbed to form a vortex flow and to increase a contact time of the means for emitting far infrared radiation and the air, such that the water molecular cluster of the air produce resonance and is atomized or made smaller by the means for emitting far infrared radiation, and a molecular freedom of the air is enhanced;

the water molecular cluster of the air has an enhanced oxygen contained area, and has an increased contact area with a fuel, such that the water molecular cluster of the air is mixed with the fuel evenly.

2. The air reactivator of claim 1, wherein the means for emitting far infrared radiation has a granularity of 0.01-30 micrometers.

3. The air reactivator of claim 1, wherein the polymer material includes polyethylene (PE), polypropylene (PP), polyurethane (PU) or Nylon.

4. The air reactivator of claim 1, wherein the means for emitting far infrared radiation has an far-infrared emissivity, more than 80%.

5. The air reactivator of claim 1, wherein the first ribs, the second ribs, and the diffusion members are formed integrally by plastic injection molding.

6. The air reactivator of claim 1, wherein the first top face has an area smaller than that of the first bottom face, the second top face has an area smaller than that of the second bottom face, and the projection has an area smaller than that of the third bottom face.

7. The air reactivator of claim 1, wherein the projection has a height greater than that of the first top face and that of the second top face.

* * * * *